US006932491B2

(12) United States Patent
Esakoff

(10) Patent No.: US 6,932,491 B2
(45) Date of Patent: Aug. 23, 2005

(54) LAMP ASSEMBLY AND LAMP FOR A LUMINARE

(75) Inventor: Gregory F. Esakoff, Huntington Beach, CA (US)

(73) Assignee: Electronic Theatre Controls, Inc., Middleton, WI (US)

( * ) Notice: Subject to any disclaimer, the term of this patent is extended or adjusted under 35 U.S.C. 154(b) by 0 days.

(21) Appl. No.: 10/294,209

(22) Filed: Nov. 14, 2002

(65) Prior Publication Data

US 2004/0095761 A1 May 20, 2004

(51) Int. Cl.[7] ..... H01R 33/00
(52) U.S. Cl. ..... 362/226; 362/399; 362/429
(58) Field of Search ..... 362/548, 549, 362/226, 285, 287, 373, 399, 418, 427, 429, 430, 457; 439/56, 57, 336, 547, 549

(56) References Cited

U.S. PATENT DOCUMENTS

| | | | | |
|---|---|---|---|---|
| 2,233,486 A | | 3/1941 | Portnow | |
| 4,704,090 A | * | 11/1987 | Marshall | 439/56 |
| 4,747,029 A | | 5/1988 | Liverance et al. | |
| 4,764,854 A | | 8/1988 | Matsune et al. | |
| 4,829,408 A | | 5/1989 | Haydu | |
| 4,841,419 A | | 6/1989 | Ohishi | |
| 5,313,378 A | | 5/1994 | Gordin et al. | |
| 5,361,191 A | | 11/1994 | Matsuzaki et al. | |
| 5,541,826 A | | 7/1996 | Sandell et al. | |
| 6,305,827 B1 | * | 10/2001 | Nolle | 362/399 |
| 6,607,293 B2 | * | 8/2003 | Suzuki et al. | 362/430 |
| 2002/0196627 A1 | * | 12/2002 | Shin | 362/429 |

* cited by examiner

*Primary Examiner*—Y. My Quach-Lee
(74) *Attorney, Agent, or Firm*—Greer, Burns & Crain, Ltd.; Philip M. Kolehmainen

(57) ABSTRACT

A theatrical luminaire for entertainment and architectural applications includes a lamp socket accessible from the exterior of the luminaire housing. A lamp includes a base, a bulb on one side of the base and a handle on the other side. The handle is grasped to insert the lamp into the socket. When the base is mounted in the socket, the bulb extends through the socket into the luminaire and the handle remains accessible at the exterior of the luminaire. The lamp is mounted with a one-handed push and turn motion, and contacts on wings of the base engage socket contacts as the lamp is turned to its final position. The socket is mounted on a support that is adjustable relative to the luminaire housing to preserve the correct lamp positioning when the lamp is replaced.

23 Claims, 7 Drawing Sheets

FIG.6
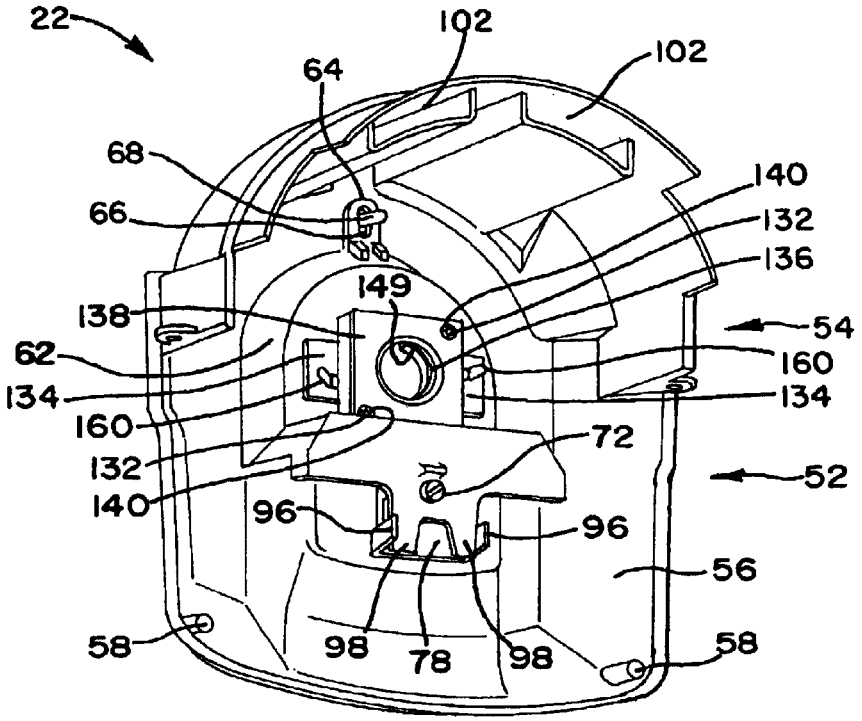
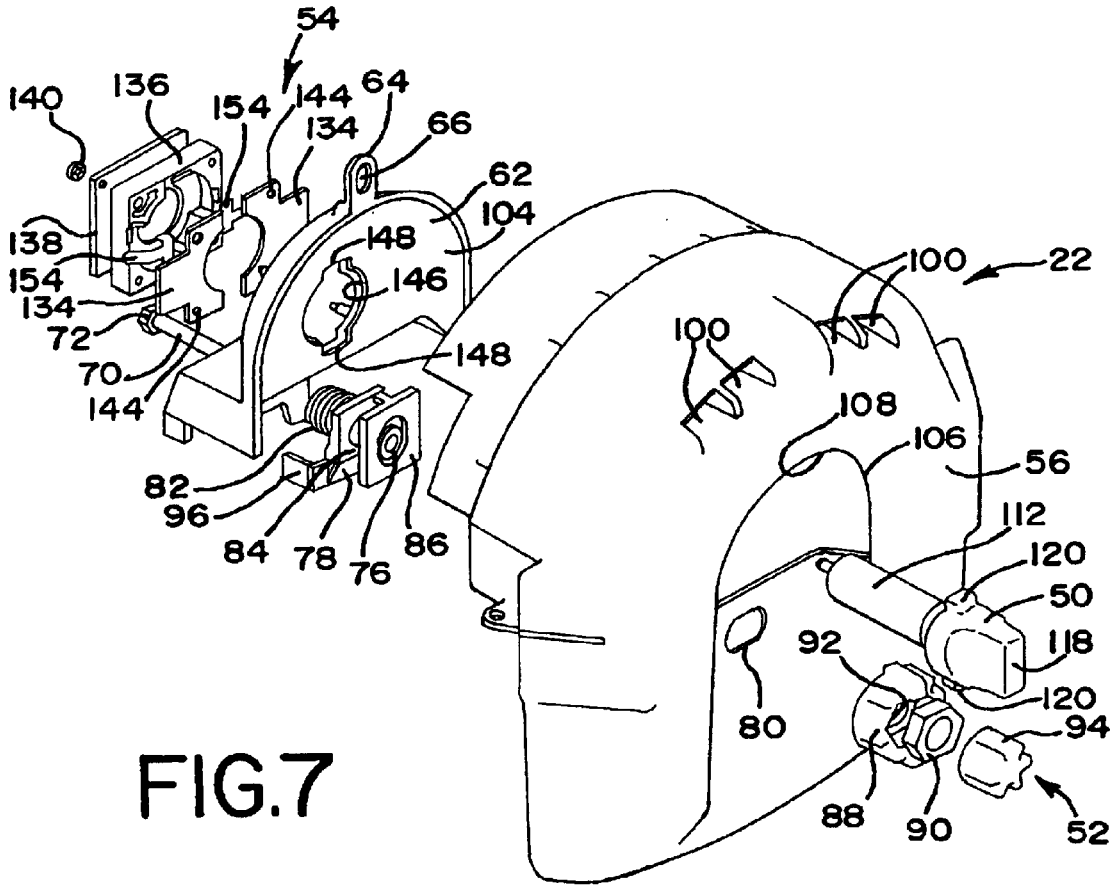
FIG.7

LAMP ASSEMBLY AND LAMP FOR A LUMINARE

FIELD OF THE INVENTION

The present invention relates to a lamp assembly and a lamp for a luminaire such as a theatrical luminaire, and more particularly to a lamp assembly and a lamp permitting quick and easy lamp exchange.

DESCRIPTION OF THE PRIOR ART

A luminaire is a light fixture including a lamp for emitting or projecting light. A "theatrical luminaire" as used here means a luminaire for creating theatrical or theatre-like lighting effects for entertainment and architectural applications such as stages, studios, buildings, themed parks, churches, museums, restaurants and the like.

Lamps used to provide light for luminaires have a finite life and require periodic replacement. In most luminaires, the lamp is mounted internally, often with fasteners or other structure making lamp exchange awkward. For example, a technician might need to climb a ladder, open or remove an access panel at the rear of the luminaire, release and extract the burned out lamp from its socket, install the new lamp and then close the access panel. The lamp replacement procedure is time consuming and difficult, and frequently requires the use of tools and/or the use of both hands. This is particularly undesirable if the luminaire is in a difficult to reach location or if a ladder is used. It is especially desirable that lamp replacement in a theatrical luminaire not only be quick and easy but also be safe even when performed by nonprofessional personnel.

Theatrical luminaires are normally used to project a specific type and character of light, such as a focused beam of light, at a selected target or area. It is important for proper performance of a luminaire such as a theatrical luminaire that the lamp be positioned at a precise location in the optical system of the luminaire. Typically a luminaire for such applications includes mechanisms for adjusting the lamp socket position for positioning the lamp. When a lamp is replaced, it is desirable that the correct lamp position be maintained. In some known luminaires, it is necessary to readjust the lamp socket position after a lamp exchange.

SUMMARY OF THE INVENTION

A primary object of the present invention is to provide an improved lamp assembly and an improved lamp for luminaires. Other objects are to provide a lamp assembly and lamp permitting safe and easy, one hand lamp replacement from the exterior of the luminaire; to provide a lamp assembly and lamp permitting luminaire lamp exchange without requiring repositioning of the lamp; to provide a lamp assembly making lamp replacement safe even for high voltage lamps and even for non-professional personnel; to provide a lamp assembly and lamp that solve problems that have existed in the past, particularly with theatrical luminaires.

In brief, in accordance with the invention there is provided a lamp assembly for a luminaire having a housing containing an optical system with a light source location. The lamp assembly includes a socket assembly supported by the housing and having inner and outer faces directed respectively toward the light source location and the exterior of the housing. A lamp receiving passage extends axially through the socket assembly between the inner and outer faces and opens onto the light source location. A contact receiving cavity extends from the lamp receiving passage between the inner and outer faces. A socket contact is mounted in the contact receiving cavity.

In brief, in accordance with another feature of the invention, there is provided a lamp for a luminaire. The lamp includes a base. A light source is supported by the base and extends in a first axial direction from a first axial side of the base. The base is larger in at least some radial direction than the light source. A handle is provided on the second axial side of the base.

BRIEF DESCRIPTION OF THE DRAWING

The present invention together with the above and other objects and advantages may best be understood from the following detailed description of the preferred embodiment of the invention illustrated in the drawings, wherein:

FIG. 6 is a front and side isometric view of the lamp assembly without the lamp;

FIG. 7 is an exploded top, side and rear isometric view of the lamp assembly;

DESCRIPTION OF THE PREFERRED EMBODIMENTS

Figure 1:
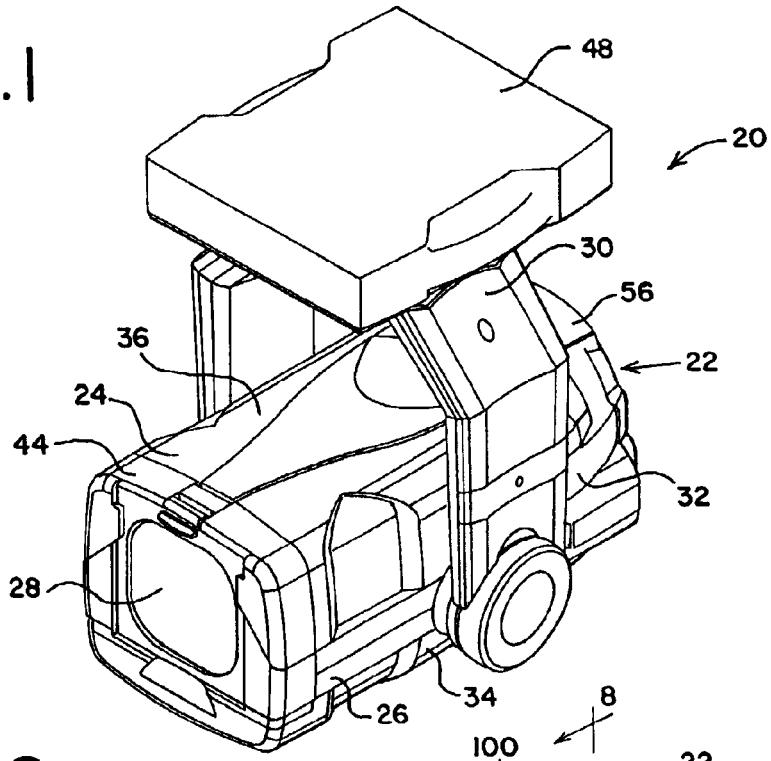
FIG. 1 is a front, top and side isometric view of a yoke mounted theatrical luminaire provided with a lamp assembly in accordance with the present invention.
Figure 2:
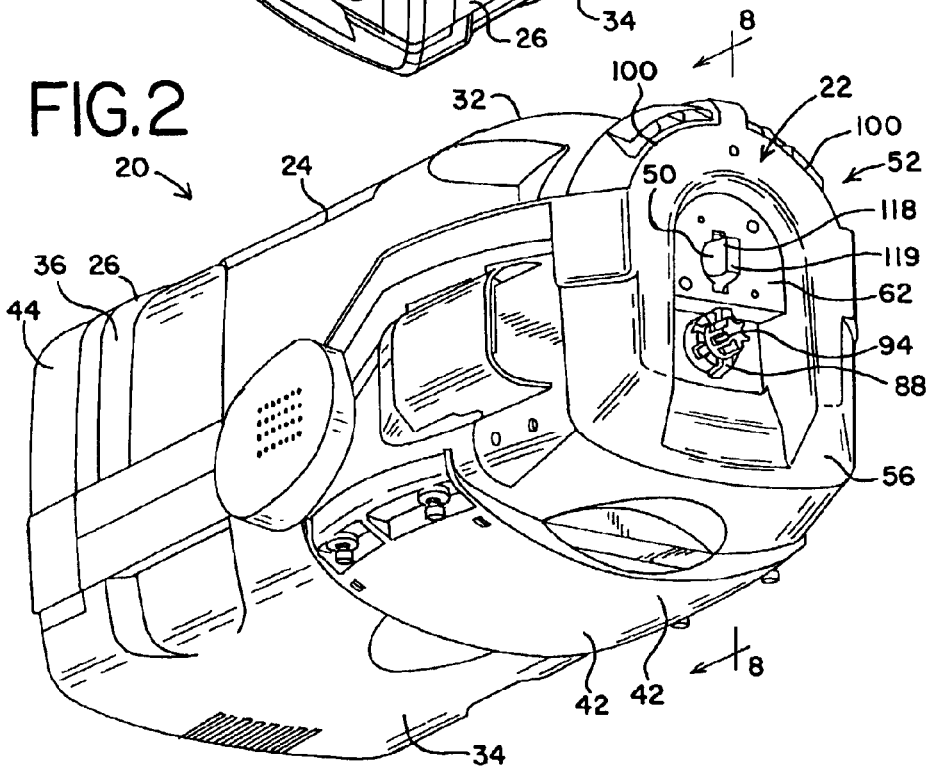
FIG. 2; is a rear, side and bottom isometric view of the luminaire.

Having reference now to the drawing, FIGS. 1 and 2 illustrate a luminaire designated as a whole as 20 and provided in accordance with the present invention with an improved lamp assembly generally designated as 22. The luminaire 20 is a theatrical luminaire, however features of the invention are useful with luminaires of other types. The luminaire 20 has a housing 24 with a front portion 26 having a light exit opening 28. As seen in FIG. 1, the housing 24 is supported for pan and tilt movement by a yoke 30. The lamp assembly 22 is mounted at a rear portion 32 of the housing 24 and provides a source of light that is optically formed into a desired light beam. The housing is moved to aim a beam of light emitted through the opening 28 at a target or an area, such as a part of a building or stage or the like.

Figure 3:
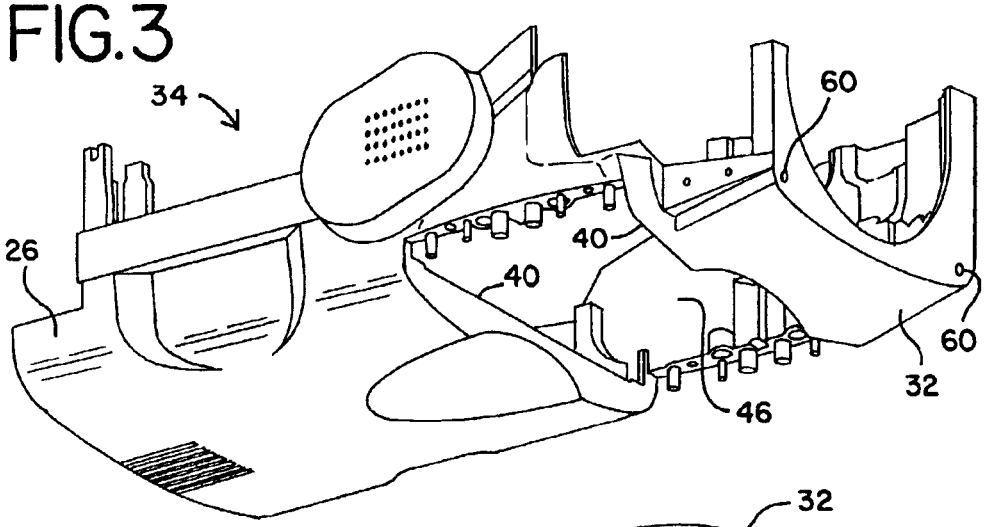
FIG. 3 is a rear, side and bottom isometric view of the base housing of the luminaire.
Figure 4:
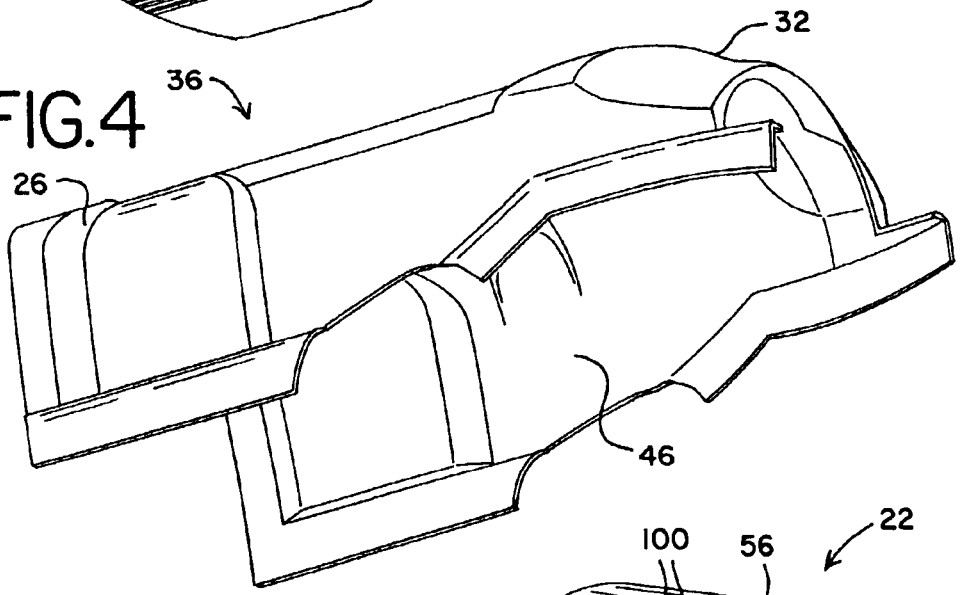
FIG. 4 is a rear, side and bottom isometric view of the housing cover of the luminaire.
Figure 5:
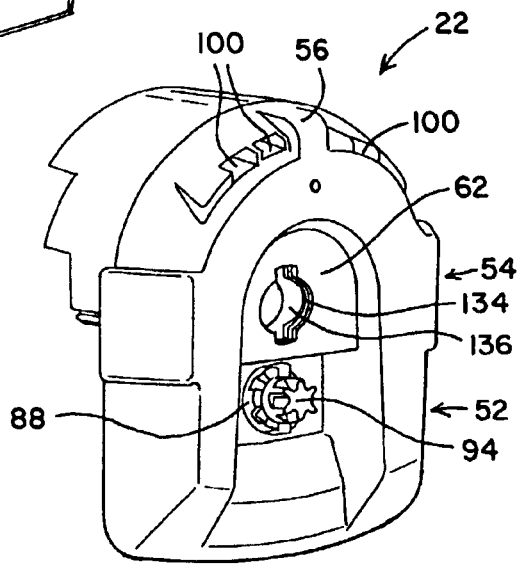
FIG. 5 is a rear and side isometric view of a lamp assembly of the luminaire without the lamp.

The housing 24 includes a lower housing 34 seen in FIG. 3 and a mating upper housing cover 36 seen in FIG. 4. The lower housing 34 is a rigid unitary body that serves as an optical rail, supporting and locating the optical components of the luminaire 20. The lamp assembly 22 is one of the optical components and is mounted on and positioned by the lower housing 34. Another optical component is a reflector 38 (FIGS. 8 and 11) that is mounted onto and positioned by the lower housing 34 independently of the lamp assembly 22. Other optical components such as lenses, diffuser, gobos, iris, shutter, etc. (not shown) are also supported by the lower housing 34. A pair of bay openings 40 are formed in the lower wall of the lower housing 34. These openings can receive modular optical components such as gobo assemblies, shutters, irises or others, or can be left empty and closed by bay opening covers 42 (FIG. 2). The front portion of the housing 24 supports a forward housing 44 that is positioned by engagement with the lower housing 34 and that may be provided with an optical component such as a gel holder or scroller or the like.

When the lower housing 34 is mated with the housing cover 36, the assembled housing 24 defines and encloses an interior region or chamber 46 of the luminaire and separates this interior region 46 from the exterior of the luminaire. The yoke 30 includes a base 48 that can be mounted overhead as by clamping to an overhead rack or frame. Alternatively the luminaire 20 can be inverted and the base 48 can be placed or secured upon a floor or horizontal surface, or the base 48 can be placed upon or secured to other supports in other orientations.

The luminaire 20 includes a lamp 50 (FIGS. 2, 7, 8, 11 and 13) located near the rear portion 32 of the housing 24. The lamp 50 has a limited service life span and requires periodic replacement. In addition, it may be desirable to replace a lamp still in service with a different type of lamp. In many applications, it can be difficult to gain access to the rear portion 32 of the luminaire, and when access is achieved, it can be difficult, awkward, or perhaps even dangerous to use two hands or tools for lamp exchange. In accordance with the present invention, the lamp assembly 22 permits lamp removal and lamp installation to be carried out with one hand.

In general, in addition to the lamp 50, the lamp assembly 22 includes a lamp positioning assembly generally designated as 52 and a lamp socket assembly generally designated as 54. The positioning assembly 52 functions to locate the lamp 50 precisely at the optically correct location relative to the optical system including the reflector 38. The socket assembly 54 releasably mounts the lamp 50 in the luminaire 20 and permits the lamp 50 to be replaced without disturbing the correct setting of the positioning assembly 52.

A lamp assembly housing 56 is secured in a predetermined location upon the rear portion 32 of the housing 24. A positioning system includes suitable fasteners and studs 58 on the lamp assembly housing 56 received in mating openings 60 in the lower housing 34 for locating the housing 56 upon the lower housing 34 in a known position relative to the reflector 38 and other optical components also positioned upon the lower housing 34. A socket support plate 62 holds the socket assembly 54 and in turn is positioned and held by the lamp positioning assembly 52 to locate the socketed lamp 50 relative to the reflector 38.

In order to permit the position of the socket assembly 54 to be adjusted, the socket support plate 62 is movably mounted upon the lamp assembly housing 56 within the interior region 46. An upper locating tab 64 of the support plate 62 has an oversize slot 66 that loosely receives a stud 68 (FIGS. 6 and 8) at the interior of the lamp assembly housing 56. The lower portion of the support plate 62 is adjustably mounted to the lamp assembly housing 56 by the lamp positioning assembly 52.

Figure 10:
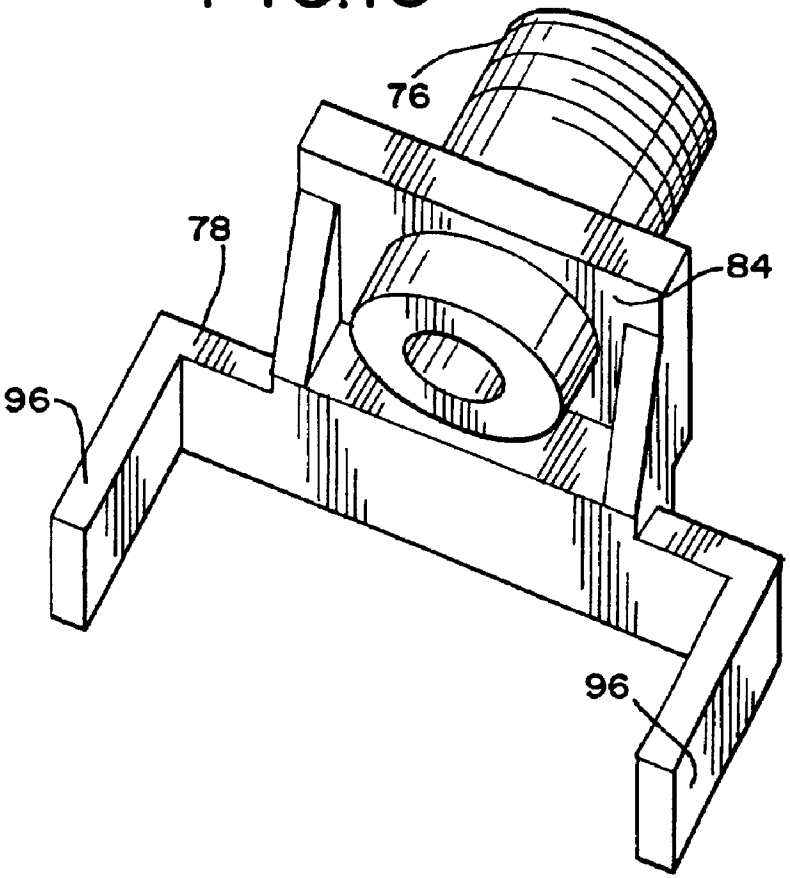
FIG. 10 is a top, front and side isometric view of the index hub of the lamp assembly.
Figure 9:
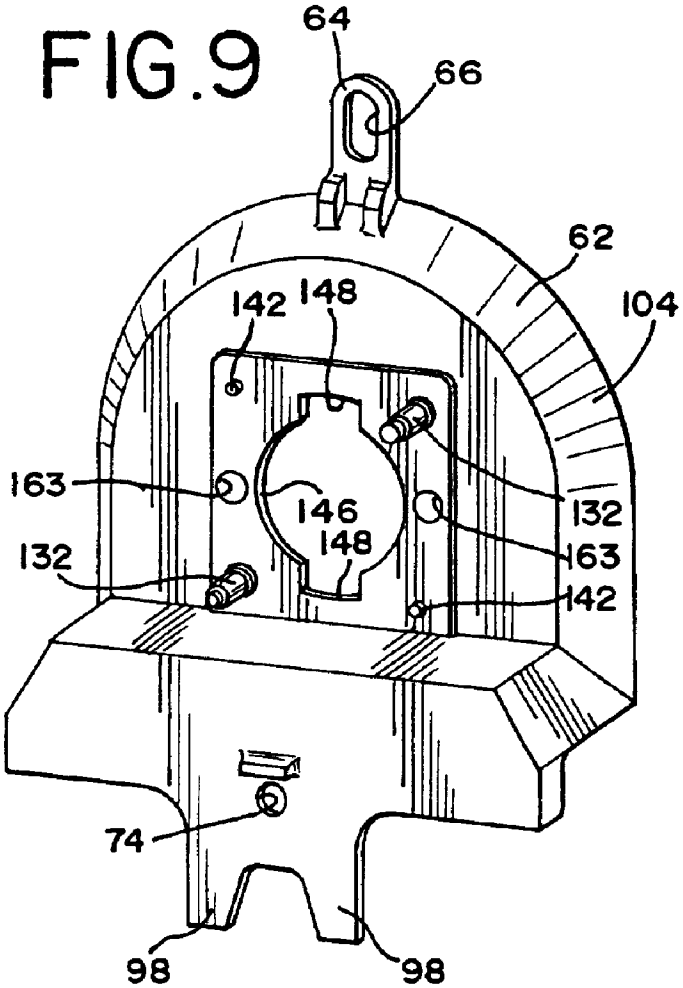
FIG. 9 is a front and side isometric view of the socket support plate of the lamp assembly.

The lamp positioning assembly 52 includes a screw 70 having a head 72 bearing against the inner surface of the socket support plate 62. The threaded shank of the screw 70 extends through a hole 74 (FIG. 9) in the plate 62. The screw extends with sliding clearance through a hub 76 of an index member 78 best seen in FIG. 10, and along with a threaded portion of the index member hub 76, extends through an opening 80 in the light assembly housing to the exterior of the luminaire 20. A coil spring 82 is seated on the inner end of the hub 76 and is held in compression between a body portion 84 of the index member 78 and the socket support plate 62. A friction pad 86 is sandwiched between the index member 78 and the interior surface of the light assembly housing 56.

At the exterior of the luminaire housing 24, a radial or X-Y adjustment knob 88 carries a female threaded nut 90 in a recess 92. The nut 90 is threaded onto the threaded hub of the index member 78. Outboard of the X-Y adjustment knob 88, an axial or Z adjustment knob 94 is threaded onto the end of the screw 70.

The lamp 50 is mounted in the lamp socket assembly 54 as described below. The lamp socket assembly 54 is carried by the socket support plate 62. In order to position the lamp 50 in the proper position relative to the reflector 38 and other optical components of the luminaire 20, the position of the socket support plate 62 is adjusted using the knobs 88 and 94.

In order to position the lamp 50 in the axial or Z direction, generally along the longitudinal, optical axis of the luminaire 20, the knob 94 is rotated. The force provided by compression of the spring 82 prevents the screw 70 from rotating as the rotating nut 90 causes the screw 70, together with the socket support plate 62, to move toward or away from the lamp assembly housing 56 in the axial direction. The spring 82 compresses or expands to permit this motion. Friction in the assembly is sufficient along with the force provided by the spring 82 to maintain the socket support plate in its adjusted position.

Figure 8:
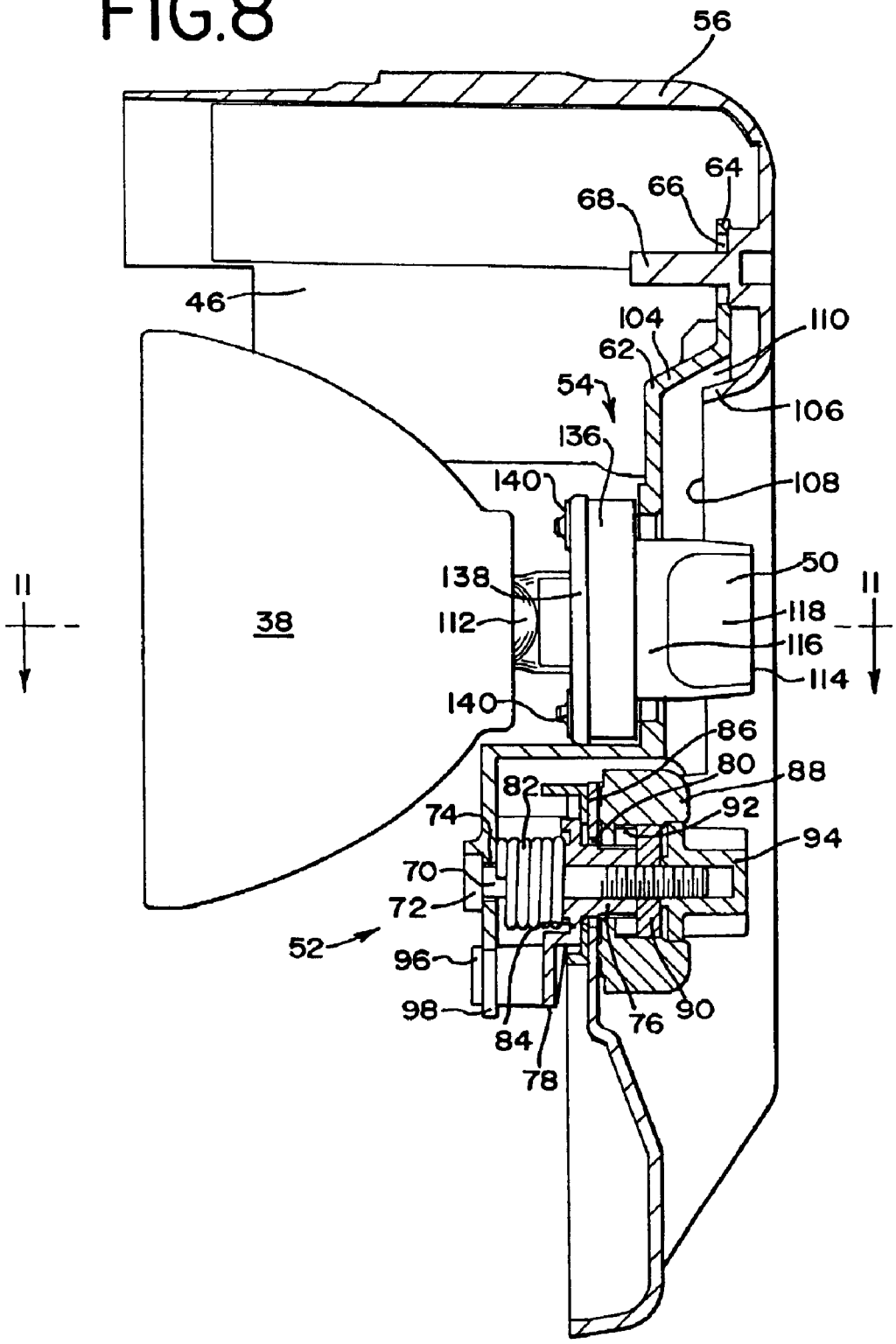
FIG. 8 is a sectional view of the lamp assembly taken along the line 8—8 of FIG. 2 and illustrating the lamp adjustment mechanism of the lamp assembly.

Normally the X-Y adjustment knob 88 is threaded along the hub 76 tight against the lamp assembly housing 56 and the housing 56 is clamped between the knob 88 and the friction pad 86 as seen in FIG. 8. The clamping force holds the socket support 62 plate stationary. In order to adjust the socket support plate in the radial or X and/or Y direction, the knob 88 is threaded away from the lamp assembly housing 56 to release the clamping force. The socket support plate 62 can now be moved in the X-Y plane by moving the knob 88 in the X and/or Y directions. This causes the socket support plate 62 to pivot around the point where the stud 68 of the lamp assembly housing 54 engages the slot 66 of the socket support plate 62. The movement of the socket support plate 62 is limited to the desired range by the opening 80 of the lamp housing 56. A pair of arms 96 of the index member 78 loosely capture legs 98 of the support plate 62. When the socket support plate 62 and the lamp 50 are properly positioned, the knob 88 is again tightened to clamp the lamp positioning assembly 52 in place.

The lamp assembly 22 permits a substantial flow of cooling air between the interior 46 and the exterior of the housing 24. The upper portion of the lamp assembly housing 56 is provided with ports 100 and cooling air ducts 102 (FIG. 6) extending forward within the interior region 46 of the luminaire housing 24. In addition, a skirt portion 104 of the socket support plate 62 overlaps within and is spaced from a rim portion 106 defining a lamp socket access opening 108 in the lamp assembly housing 56. The space between the rim 106 and skirt 104 defines a large area cooling flow passage 110. The ducts 102 and the overlap between skirt 104 and rim 106 block the escape of light from the interior region 46 of the housing 24 through the cooling air passages.

Figure 13:
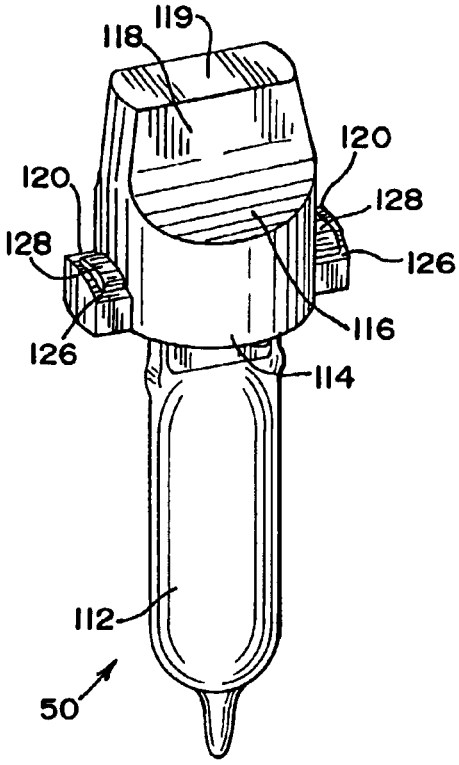
FIG. 13 is a rear and side isometric view of the lamp of the lamp assembly.
Figure 14:
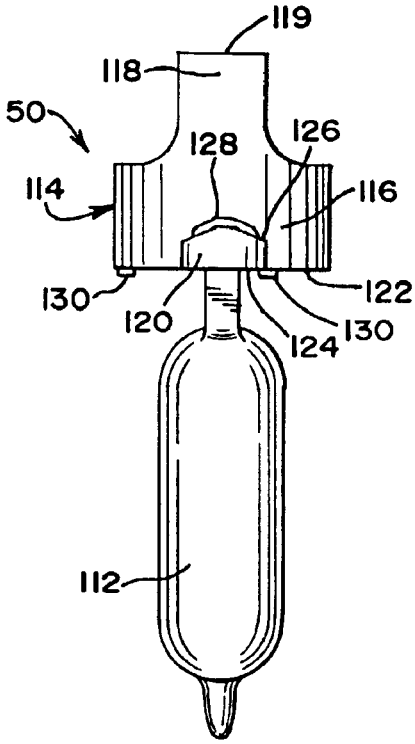
FIG. 14 is a side view of the lamp of the lamp assembly.

The lamp 50 as best seen in FIGS. 13 and 14 includes an elongated, generally cylindrical glass bulb 112 mounted upon the inner end of a carrier 114. The lamp 50 is an incandescent lamp with a filament or filament array enclosed in the bulb 112. Other types of lamps having other light sources in place of the bulb 112 may be used. The carrier 114 is a monolithic body made of a suitable electrically insulating and heat tolerant material, for example a ceramic, and is shaped for convenient one-hand bulb mounting and removal in the socket assembly 54. The carrier 114 includes a generally cylindrical or disk-like annular base portion 116 with the bulb 112 extending coaxially from the inner side of the base 116. A handle portion 118 of the carrier 114 is formed on the outer side of the base 116, opposite to the bulb 112.

The handle 118 is a single, elongated rib coinciding with a diameter of the disk shaped base 116. The handle 118 intersects the axis of the bulb 112 and of the base 116, and the center of the handle 118 is located at the center of the base 116. The handle 118 has a uniform thickness throughout its length, and has a thickness is in the range of from about five to about twenty millimeters so that it is comfortably and securely held between the thumb and forefinger. A planar outer surface 119 of the handle 118 is visible at the exterior of the luminaire 20 when the lamp 50 is installed (FIG. 2). Printed indicia or a label or the like can be placed upon surface 119 to provide the user with information about the lamp, such as its model number, manufacturer and amperage, voltage and or wattage rating or the like.

The carrier 114 includes a pair of mounting wings 120 extending radially outward from the base 116 at diametrically opposed locations along the periphery of the base 116. In the preferred arrangement the wings 120 and the handle 118 are located along the same diameter of the base 116. The axial thickness of the wings 120 is less than the thickness of the base 116 and is preferably about one-half or slightly less than one-half the thickness of the base 116. The base 116 has an inner surface 122 where the bulb 112 is supported and the wings 120 have inner surfaces 124 coincident with the surface 122. The outer surfaces 126 of the wings 120 are curved and convex.

Each wing 120 supports a lamp contact 128 for connecting the lamp 50 to an electrical power supply. The contacts 128 are located upon the outer surfaces 126 of the wings 120 so that they face in the same direction as the handle 118 and face in the opposite direction as the bulb 112. The inner surface 122 of the base 116 includes integral, formed standoffs 130. The contacts 128, like the outer wing surfaces 126, are curved in a convex shape. Lamp 50 may be an incandescent lamp with a filament or filament array mounted within the bulb 112 and operating at normal mains voltage. Alternatively the lamp 50 may be a high voltage type, such as a high intensity discharge lamp operating at a high voltage. The arrangement of lamp contacts 128 at widely spaced positions at diametrically opposed points of the base 116 separates and isolates the contacts 128 so that they can be accommodate a high voltage power supply.

Figure 11:
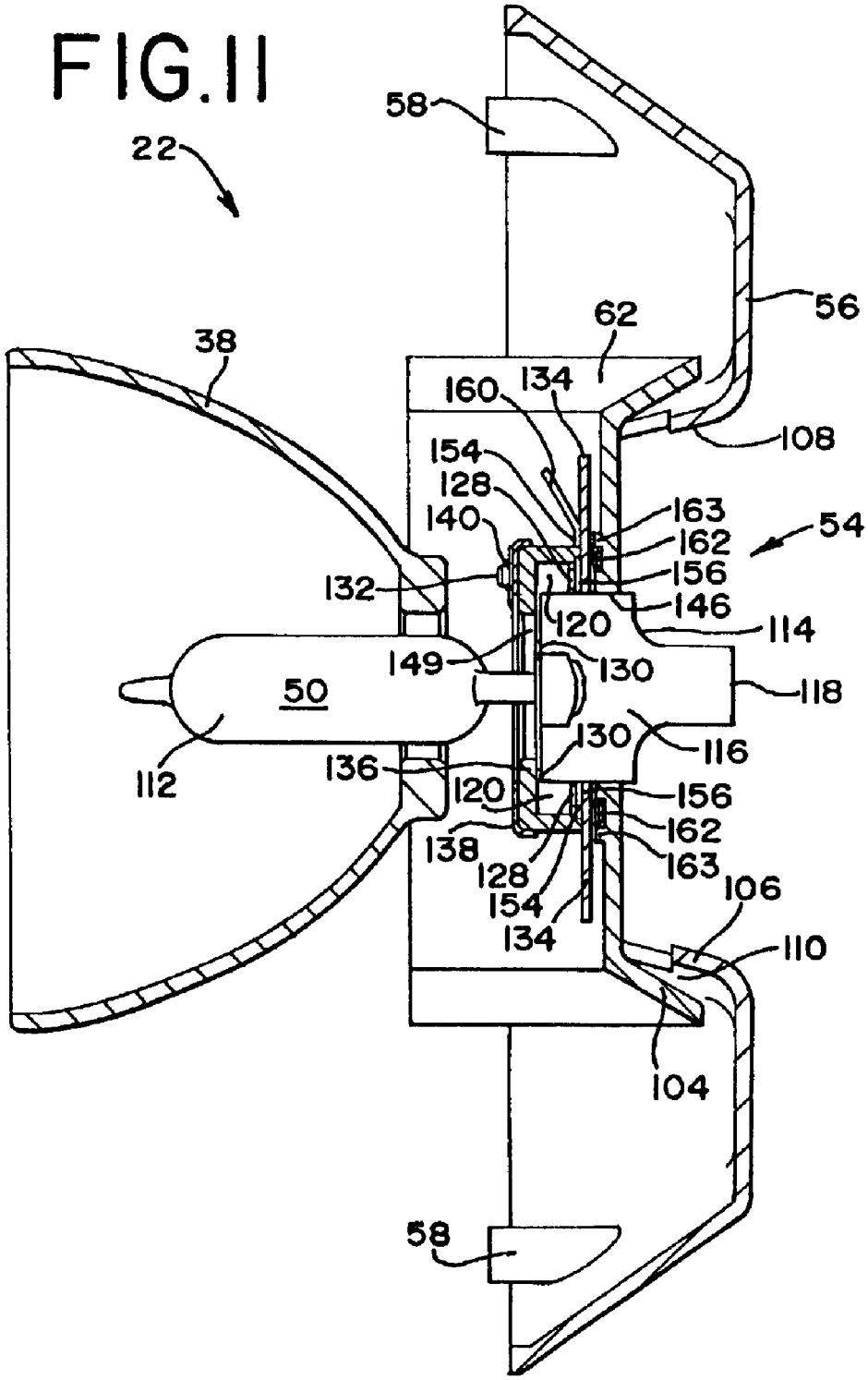
FIG. 11 is a sectional view taken along the line 11—11 of FIG. 8 illustrating the lamp socket assembly of the lamp assembly.
Figure 12:
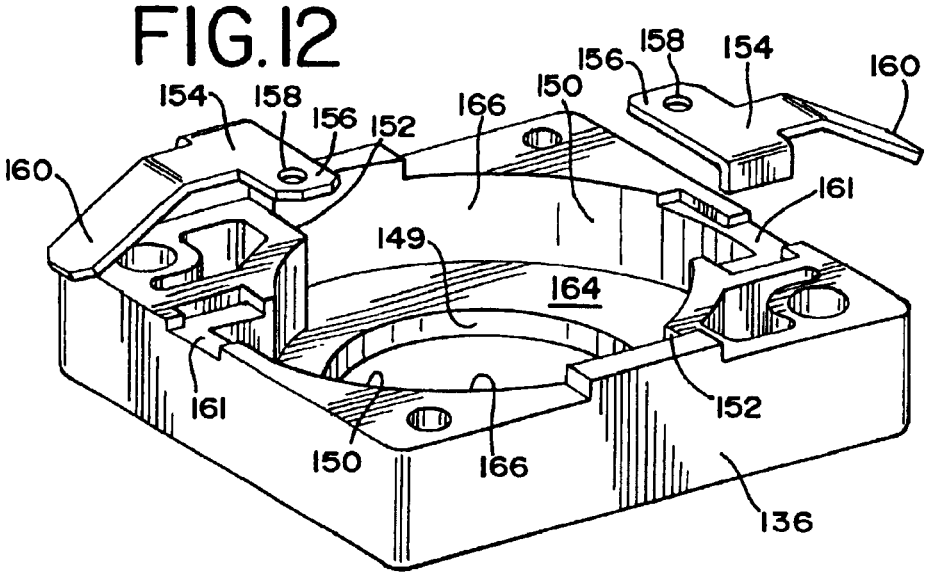
FIG. 12 is an exploded front and top isometric view of the lamp socket housing and lamp socket terminals of the lamp socket assembly.

The lamp socket assembly 54 accepts the lamp 50 with a one handed installation or removal operation, and securely and safely mounts the lamp 50. The socket assembly 54 is carried by the socket support plate 62 so that the lamp 50 can be correctly positioned relative to the optical system of the luminaire 20 including the reflector 38. A pair of mounting studs 132 (FIG. 9) are formed on the front or inner surface of the support plate 62. These studs extend through openings in a pair of insulator plates 134, openings in a socket housing 136 and openings in a socket backing plate 138. Retention washers 140 are pressed onto the inner ends of the studs 132 to hold the plates 134, housing 136 and backing plate 138 in assembly as seen in FIG. 11. Projections 142 on the inner surface of the support plate 62 engage additional openings 144 in the insulators 134 to hold them in position. The outer surface of the support plate 62 provides an outwardly directed outer face of the socket assembly 54. The socket backing plate 138 provides an inwardly directed inner face of the socket assembly 54.

A keyed opening in the socket support plate 62, accessible through the socket access opening 108 of the lamp assembly housing 56, has a circular central portion 146 and opposed extensions 148 for receiving the wings 120 of the lamp 50. The keyed opening determines the position of the lamp when it is inserted into the socket assembly 54. The central portion 146 of the keyed opening receives the bulb 112, and the socket housing 136 includes a central opening 149 that permits the bulb 112 to extend through the socket assembly 54 and into the reflector 38 when the lamp base 116 is received into the socket assembly 54. The central opening 149 is smaller in the radial direction than the base 116, and does not include extensions corresponding the wings 120. When the lamp 50 is mounted in the socket assembly, the base 116 with the wings 120 cannot pass through the opening 149. The base 116, wings 120 and contacts 128 are captured in the socket assembly 54, while the bulb extends inwardly beyond the socket assembly 54, and the handle 118 is exposed and accessible at the exterior of the luminaire.

The lamp 50 is installed with a two step, push and turn operation. The socket housing 136, sandwiched between the insulators 134 and the backing plate 138, has a pair of opposed quadrant shaped recesses 150 that receive the wings 120 and lamp contacts 128 when the lamp is inserted axially through the keyed opening including the central portion 146 and extensions 148. Radially positioned abutment walls 152 of the recesses 150 permit the lamp 50 to be rotated in one direction (clockwise as viewed from the rear, e.g. FIG. 2) and prevent the lamp from being rotated in the other direction.

Stamped and formed metal socket terminals 154 are received in the socket housing 136, one in each recess 150. Each terminal 154 has an internal contact 156 and may include a dimple 158 or other retention projection and an upturned end flange providing a stop for a mating lamp contact. Each terminal 154 also includes an external contact 160 that extends through a channel 161 in the socket housing 136 to the exterior of the socket assembly 54 for connection to a power supply for the lamp 50. Contact springs 162 (FIG. 11) are compressed between the insulators 134 and the socket support plate 62. The springs 162 are received in seats 163 formed in the plate 62 (FIG. 9) and are held in alignment with the internal contacts 156 of the socket terminals 154 to resiliently urge the contacts 156 axially inward within the socket housing recesses 150.

To insert or replace a lamp 50 of the luminaire 20, it is not necessary to gain access to the interior region 46 of the luminaire housing 24. The entire lamp replacement is done from the exterior of the luminaire. The user grasps the lamp handle 118 between thumb and forefinger of one hand. The user has the second hand free. The lamp is then inserted axially through the keyed opening 146 in the socket support plate 62. The wings 120 move through the extensions 148 and into the quadrant shaped recesses 150 in the socket housing 136. The standoffs 130 on the lamp base 116 bottom against a bottom wall 164 of the recesses 150 to position the lamp 50 in the axial or Z direction in the socket assembly 54. The wings 120 are captured within arcuate outer walls 166 of the recesses 150 to locate the lamp 50 in the radial or X and Y directions in the socket assembly 54.

When the lamp 50 bottoms in the socket housing 136, it is then rotated to move the lamp contacts 128 into engagement with the internal contacts 156 of the socket terminals 154. The contacts 128 and 156 engage with a wiping action and the terminals 128 are retained in their final position by the dimples 158. The convex, rounded shape of the contacts 128 and wing surfaces 126 permits the contacts 128 to move across the dimples 158, and cooperates with the dimples 158 in retaining the lamp 50 in place. The contact springs 162 resiliently maintain engagement between contacts 128 and 156 and also hold the lamp in its bottomed position with standoffs 130 in engagement with the bottom wall 164. The lamp is securely held by dimples 158 augmented by the force of springs 162 and cannot inadvertently exit from the socket assembly 54.

Lamp removal is effected in a similar manner with one hand. The handle 118 is grasped and rotated to overcome the lamp retention force and move the wings 120 into alignment with the extensions 148. Then the lamp 50 is withdrawn axially from the luminaire 20. When the lamp 50 is installed or removed, the lamp contacts 128 do not engage the socket contacts 156 until the wings are rotated well into the recesses 150 and under the insulators 134. The lamp 50 is disconnected from the power supply before it is removed. No additional safety interlock or switch or the like is required, even for high voltage lamps. This safety feature permits lamp replacement by a non-professional because at no time can the user come in contact with a contact or other conductive element that is in electrical contact with the power supply or with the socket terminals 154.

When a lamp 50 is replaced, it is not necessary to use the lamp positioning assembly 52 to reposition the new lamp 50. The newly installed lamp is positioned by mating with the socket assembly 54, and the socket assembly is carried by the previously positioned socket support plate 62. The preexisting lamp position is not disturbed by removal of one lamp 50 and installation of a different lamp 50.

While the present invention has been described with reference to the details of the embodiments of the invention shown in the drawing, these details are not intended to limit the scope of the invention as claimed in the appended claims.

What is claimed is:

1. A lamp assembly for a luminaire having a housing with an exterior and containing an optical system with a light source location, said lamp assembly comprising:

a socket assembly supported by said housing and having inner and outer faces directed respectively toward the light source location and the exterior of the housing;

a lamp receiving passage accessible from the exterior of the housing and extending axially through said socket assembly between said inner and outer faces and opening onto the light source location;

a keyed opening at said outer face aligned with said lamp receiving passage, said keyed opening including a radial extension;

a contact receiving cavity extending radially from said lamp receiving passage between said inner and outer faces, said cavity including a first portion axially aligned with said radial extension and a second portion peripherally offset from said first portion; and a socket contact mounted in said second portion of said contact receiving cavity, said first portion of said contact receiving cavity being spaced from said socket contact.

2. A lamp assembly as claimed in claim 1 including a pair of said contact receiving cavities extending radially from said lamp receiving passage, each of said contact receiving cavities containing a said socket contact.

3. A lamp assembly as claimed in claim 2, said contact receiving cavities and said socket contacts being diametrically opposed to one another along said lamp receiving passage.

4. A lamp assembly as claimed in claim 2 further including a lamp including a base including a pair of radially extending wings, a light source extending axially from one side of said base, and a handle on the other side of said base, said base being mounted in said lamp receiving passage of said socket assembly between said inner and outer faces, said light source being positioned at said light source location, a pair of lamp contacts mounted on said wings and engaging said socket contacts in said contact receiving cavities.

5. A lamp assembly as claimed in claim 1 further including a lamp including a base, a light source extending axially from one side of said base, and a handle on the other side of said base, said base being mounted in said lamp receiving passage of said socket assembly between said inner and outer faces, said light source being positioned at said light source location.

6. A lamp assembly as claimed in claim 5, said base having a radially extending wing, and a lamp contact mounted on said wing and engaging said socket contact in said contact receiving cavity.

7. A lamp assembly for a luminaire having a housing with an interior and an exterior, said lamp assembly comprising:

a socket supported by said housing;

a lamp including a base, a light source extending axially from one side of said base, and a handle on the other side of said base;

said socket including a passage extending axially through said socket to the interior of the housing; and said passage being configured to receive said light source when said lamp is inserted into said socket to a mounted position wherein said base is received in said socket, said lamp extends beyond said socket into the interior of the housing, and said handle is directed toward the exterior of the housing; and said socket including socket contacts, said base including lamp contacts, and said lamp contacts engaging said socket contacts in said mounted position;

said socket including an entrance opening configured to receive said light source and said base, said passage being smaller than said entrance opening to block movement of said base and hold said base in said socket.

8. A lamp assembly as claimed in claim 7, said entrance opening being keyed to said base.

9. A lamp assembly-for a luminaire having a housing with an interior and an exterior, said lamp assembly comprising:

a socket supported by said housing;

a lamp including a base, a light source extending axially from one side of said base, and a handle on the other side of said base;

said socket including a passage extending axially through said socket to the interior of the housing;

said passage being configured to receive said light source when said lamp is inserted into said socket to a mounted position wherein said base is received in said socket, said lamp extends beyond said socket into the interior of the housing, and said handle is directed toward the exterior of the housing;

said socket including an entrance opening configured to receive said light source and said base, said passage being smaller than said entrance opening to block movement of said base and hold said base in said socket;

said entrance opening being keyed to said base and said socket including a socket housing having a cavity permitting said base to rotate after entry into said into-said entrance opening.

10. A lamp assembly as claimed in claim 9, further comprising a lamp contact on said base and a socket contact mounted in said cavity, said lamp contact and said socket contact being engageable with one another upon said rotation of said base.

11. A lamp assembly for a luminaire having a housing with an interior and an exterior, said lamp assembly comprising:

a socket supported by said housing;

a lamp including a base, a light source extending axially from one side of said base, and a handle on the other side of said base;

said socket including a passage extending axially through said socket to the interior of the housing;

said passage being configured to receive said light source when said lamp is inserted into said socket to a mounted position wherein said base is received in said socket, said lamp extends beyond said socket into the interior of the housing, and said handle is directed toward the exterior of the housing;

said socket including an entrance opening configured to receive said light source and said base, said passage being smaller than said entrance opening to block movement of said base and hold said base in said socket;

said entrance opening being keyed to said base; and said base having a pair of radially projecting wings and said entrance opening having radial extensions receiving said wings.

12. A lamp assembly as claimed in claim 11, said socket including a socket housing having a pair of cavities receiving said wings and permitting said base to rotate after axial movement of said wings through said extensions.

13. A lamp assembly as claimed in claim 12, lamp contacts mounted on said wings and socket contacts mounted in said cavities, said lamp contacts being spaced from said socket contacts when said wings move axially through said extensions, and said lamp contacts engaging said socket contacts when said base rotates after axial movement of said wings through said extensions.

14. A lamp assembly as claimed in claim 13, said lamp contacts being mounted on surfaces of said wings facing axially away from said light source and facing toward said handle.

15. A lamp assembly for a luminaire having a housing with an interior and an exterior, said lamp assembly comprising:

a socket supported by said housing;

a lamp including a base, a light source extending axially from one side of said base, and a handle on the other side of said base;

said socket including a passage extending axially through said socket to the interior of the housing;

said passage being configured to receive said light source when said lamp is inserted into said socket to a mounted position wherein said base is received in said socket, said lamp extends beyond said socket into the interior of the housing, and said handle is directed toward the exterior of the housing; and said socket including a socket support plate and a socket housing mounted on said socket support plate, said socket support plate being adjustably mounted on the housing for positioning of said socket relative to said housing.

16. A lamp assembly for a luminaire with an exterior, the luminaire having a housing separating the exterior of the luminaire from an internal region contained within the housing; said lamp assembly comprising:

a lamp including a bulb, a base and a handle;

a socket mounted in the internal region of the luminaire releasably receiving said base;

said bulb being in the interior region of the luminaire when said base is received in said socket; and said handle projecting outwardly from said socket when said base is received in said socket said socket including a socket support plate adjustably mounted relative to said housing.

17. A lamp for a theatrical luminaire comprising:

a base;

a light source supported by said base and extending in a first axial direction from a first axial side of said base;

an electrical lamp contact attached to said base;

said base having a radially projecting portion larger in at least some radial direction than said light source; and a handle on the second axial side of said bases;

said contact being mounted on said radially projecting portion and facing in a second axial direction opposite to said light source.

18. The lamp of claim 17, said base and handle being a single monolithic carrier of electrically insulating and heat tolerant material.

19. The lamp of claim 18, said base being generally cylindrical and said handle being a rib formed on said base and extending diametrically across the base.

20. The lamp of claim 19, said rib having a planar surface extending across the diameter of the base and having a width sufficient to allow said planar surface to display indicia.

21. A lamp for a theatrical luminaire comprising:

a base;

a light source supported by said base and extending in a first axial direction from a first axial side of said base;

said base being larger in at least some radial direction than said light source; and a handle on the second axial side of said base said base and handle being a single monolithic carrier of electrically insulating and heat tolerant material;

said base including radially outwardly extending wings, and electrical lamp contacts carried on said wings.

22. A lamp for a theatrical luminaire consisting essentially of:

a light emitting bulb having an axis;

a base attached to one axial end of said bulb;

electrical lamp contacts attached to said base;

said base having a radially projecting portion being larger in at least some radial direction than said bulb; and a handle on said base opposite said bulbs;

said contacts being mounted on said radially projecting portion and facing in an axial direction opposite to said bulb.

23. A lamp assembly as claimed in claim 1, further comprising a contact biasing spring mounted in said contact receiving cavity and engaging said socket contact.

* * * * *